US005900578A

United States Patent [19]

Wathen

[11] Patent Number: 5,900,578

[45] Date of Patent: May 4, 1999

[54] METHOD OF BREAKING SLABS AND EXPLOSIVE SHOCK TRANSMITTING AND MODERATING COMPOSITION FOR USE THEREIN

[76] Inventor: Boyd J. Wathen, 7045 W. 9600, N. Lehi, Utah 84043

[21] Appl. No.: 08/879,743

[22] Filed: Jun. 20, 1997

Related U.S. Application Data

[63] Continuation-in-part of application No. 08/781,880, Jan. 10, 1997.

[51] Int. Cl.[6] ..... F42B 3/00

[52] U.S. Cl. ..... 102/313; 102/302; 102/303; 102/312; 102/333; 149/19.1; 149/118

[58] Field of Search ..... 102/302, 303, 102/312, 313; 149/19.1, 118

[56] References Cited

U.S. PATENT DOCUMENTS

| | | | |
|---|---|---|---|
| 2,055,618 | 9/1936 | Blau | 102/333 |
| 3,671,342 | 6/1972 | Slawinski | 149/118 X |
| 4,198,454 | 4/1980 | Norton | 428/117 |
| 4,548,660 | 10/1985 | Ikeda et al. | 149/21 |
| 4,614,146 | 9/1986 | Ross et al. | 86/20 C |
| 4,790,890 | 12/1988 | Miller | 199/2 |
| 4,836,079 | 6/1989 | Barrett | 86/50 |
| 5,233,926 | 8/1993 | Charmichael et al. | 102/313 X |
| 5,273,110 | 12/1993 | Fitzgibbon, Jr. . | |
| 5,584,222 | 12/1996 | Engsbraten et al. | 86/20.15 |

FOREIGN PATENT DOCUMENTS

| | | | |
|---|---|---|---|
| 14005 | 11/1985 | United Kingdom | 102/333 |

*Primary Examiner*—Peter A. Nelson
*Attorney, Agent, or Firm*—Mallinckrodt & Mallinckrodt

[57] ABSTRACT

Rock slabs or pieces are broken from larger rocks or from rock formations with reduced cracking of the broken rock slabs or pieces by drilling bore holes along the desired break lines, placing detonating cord into the bore holes, filling the bore holes with a shock transmitting and moderating composition, and detonating the detonation cord. The shock transmitting and moderating composition is preferably a gel with shock absorbing material such as microspheres or micro gas bubbles suspended therein. Openings in rock can also be formed by drilling at least one bore hole within the desired opening and drilling a plurality of bore holes along the desired periphery of the desired opening. Explosives within the at least one bore hole within the desired opening is detonated to break rock within the opening and detonating cord in the bore holes along the desired periphery of the desired opening which holes are filled with a shock transmitting and moderating composition is detonated to break the rock inwardly of the desired periphery while leaving stable the rock outwardly of the periphery.

20 Claims, 1 Drawing Sheet

METHOD OF BREAKING SLABS AND EXPLOSIVE SHOCK TRANSMITTING AND MODERATING COMPOSITION FOR USE THEREIN

RELATED APPLICATIONS

This is a continuation-in-part of application Ser. No. 781,880 filed Jan. 10, 1997.

BACKGROUND OF THE INVENTION

1. Field

The invention is in the field of blasting blocks of rock from larger rock formations or larger blocks such as the blasting of loaves and blocks of rock in quarries, and in the field of blasting openings in rock.

2. State of the Art

In quarries, and particularly dimension stone quarries such as granite, marble, and limestone quarries, it is usual practice to break large pieces of rock, generally referred to as loaves, from the solid rock formation, and then, either at the site, or at a different site to which the loaves are moved, break the loaves into smaller blocks that are then further cut and finished to provide the finished rock product. The loaves are generally up to about fifty feet in length by about twenty feet in width by about fifteen feet in height and weigh in the range of about fifteen thousand tons. The smaller blocks into which the loaves are broken typically are about six feet in width by about five feet in height by about six to eight feet in length.

In separating the loaves from the solid rock formation, cuts in the rock to define the ends of the loaves are generally made by water jet cutting or by burning or spalling. Once the ends are cut to define the length of the loaf and to provide relief, bore holes are drilled into the rock along the desired lines of breakage at the back of the loaf and the bottom of the loaf between the end cuts. These bore holes are then filled with an explosive, the explosive is detonated, and the detonation separates the loaf of rock from the solid rock formation. Depending upon the explosives used, the holes along a horizontal break line (the bottom of the loaf) may be drilled at a slight angle in order to hold a liquid. This angle is normally about 2° but may range up to about 60°. The loaves are then further broken into the smaller blocks. These smaller blocks are moved to the finishing facility and cut and finished. Current practice in forming the smaller blocks at granite and similar quarries is to drill the loaves along further desired break lines. Holes about 1¼ inches in diameter are drilled about every 5½ inches along the desired break lines. The holes are drilled almost through the block, but not all of the way through so the holes will hold water therein.

In blasting the smaller blocks, small explosive power is all that is needed. Such power can be provided by a length of detonating cord inserted into the hole and extending the entire length of the hole. However, the standard hole drilled in the rock is about 1–1¼ inch in diameter. Explosives filling such a hole would be much too powerful to provide the desired breaks and would result in significant overbreakage causing the rock to split where not desired and unwanted cracks to form extending peripherally around the diameter of the blast hole rendering much of the rock damaged, unusable, and wasted. The detonating cord, however, is significantly smaller in diameter than the diameter of the hole. If the detonating cord is merely placed in the hole and detonated, most of the explosive power is absorbed by the air in the empty hole and the blast is not effective to crack and break the rock along the desired break line. In some cases, if detonating cord of relatively large explosive power is used, it can merely be placed in the hole in air and detonated. However, this uses much more explosive power than necessary. Current practice in many quarries is to place the detonating cord in the hole, fill the hole with water, and then detonate the cord. The water transmits the explosive force of the detonation hydrostatically to the rock and the rock is broken as desired. However, the force of the explosion usually causes many small cracks, called spider cracks, to form extending from the hole anywhere from three inches to one foot into the rock. In finishing the block of rock, it is necessary to cut off the rock having the spider cracks. This wastes a substantial amount of the rock which is an economic loss to the quarry. For example, if the spider cracks extend three inches into the rock on all sides so that three inches is cut off all sides of a five by six by eight foot block, this wastes almost twelve percent of the rock in the block. If cracks extend twelve inches into the block so twelve inches of rock has to be cut, over forty percent of the block is wasted.

Where high quality stone is being broken into blocks and the excessive waste due to spider cracks is to be avoided, the blocks can be broken by wedging. In wedging, steel wedges are manually driven into the bore holes along the desired break line to force the block to break and separate from the loaf. However, the wedging is labor intensive and time consuming so use of explosives for breaking the block is generally preferred.

Attempts have been made to reduce the spider cracks in the rock blocks by arranging the detonating cord in the bore hole so that it extends down one side of the bore hole and up the other against the rock to be broken along the desired break line and the hole is then filled with sand rather than water. However, for the sand to be effective and to effectively flow into and fill a 1–1¼ inch diameter bore hole, the sand has to be very dry. It is extremely difficult to keep sand as dry as necessary in a quarry and even dry sand is difficult to pour into the hole. Generally dry sand is about forty percent void space. While this procedure appears to reduce cracking to some extent it is not as effective as desired and, in addition to the difficulty in filling the holes with sand, it is difficult and time consuming to correctly line-up the detonating cord and to provide the separations necessary to keep the cord apart and correctly aligned.

In many cases, in addition to breaking loaves into smaller blocks, the detonating cord with surrounding water provides enough explosive power for breaking the large loaves of rock from the solid rock formation so the water and detonating cord can be used in those situations also. However, there is still the problem of spider cracks that have to be removed before the rock is ready for finishing.

SUMMARY OF THE INVENTION

According to the invention, an explosive remains effective in breaking rock loaves from rock formations and in breaking the rock loaves into smaller blocks, yet the explosive force is modified to substantially reduce cracking or damage to the broken blocks thereby allowing greater effective use of the blocks by replacing the water normally used with detonating cord in a bore hole with a shock transmitting and moderating composition. The shock transmitting and moderating composition is preferably an aqueous gel having shock absorbing material, such as microspheres, suspended therein. In some instances, the shock absorbing material can be micro gas bubbles suspended in the gel. Bore holes are formed in normal manner in the rock formation or in the rock loaf to be further broken, the detonating cord inserted into the holes for substantially the entire length of the holes, and the bore holes filled with the shock transmitting and moderating composition of the invention. The detonating cord is placed in the bore hole without any special placement or alignment necessary.

The shock absorbing means or material suspended in the gel is preferably microspheres, such as glass microspheres, and the gel in one embodiment is preferably made from a gum such as a guar gum and water or from a high molecular weight acrylic thickener and water. Gels made with between about 0.6% and about 2% guar gum in water, and with between about 0.6% and about 2% glass microspheres have been found satisfactory. In some cases a pH adjustment will be necessary to form and maintain the gel. Glacial acetic acid or vinegar may be added to keep the pH value in the range of about 3.5 to about 6. A preservative is also sometimes used. The gel is easily mixed by adding the gel and energy absorbing material to water and mixing. It has also been found satisfactory, where shelf life is not important, to provide very small gas bubbles in the gel rather than microspheres. These bubbles may be formed during the mixing of the gel by bubble generating material such as sodium bicarbonate which generates small gas bubbles as it is mixed with water.

In a second embodiment of the invention, the gel is made from a high molecular weight acrylic thickener and water. A thickener such as Colloid 1560 from Rhone Poulenc has been found satisfactory. Again, the pH of the mixture is adjusted to cause the thickening. It has been found that with the acrylic thickener, a concentrated gel can be made up at a central location and transported to the site of use where it is diluted with water to desired consistency and used. This makes transportation of the composition easier and less expensive because less water (less weight) is transported while allowing the composition to be manufactured at a central location.

The make-up of the gel will depend upon the specific characteristics of the rock to be broken and the explosive strength of the detonating cord being used. Thus, the percentage of energy absorbing means can be adjusted as desired to adjust the explosive force transmitted to the rock being broken. With the adjustments that can be made to the gel along with a selection of explosive power of the detonating cord, the invention can be tailored to effectively break most quarried rocks without damaging the rocks.

The invention can also be used in blasting openings in rock where stability of the rock surrounding the opening is important.

THE DRAWINGS

The best mode presently contemplated for carrying out the invention is illustrated in the accompanying drawings, in which:

FIG. 1 is a perspective view of a portion of a rock quarry showing a loaf to be separated from the rock formation;

FIG. 2, a perspective view of a rock loaf separated from a rock formation and ready to be broken into smaller blocks;

FIG. 3, a perspective view of one of the smaller blocks ready to be broken into still smaller blocks;

FIG. 4, a fragmentary vertical section taken on the line 3—3 in FIG. 2; and FIG. 5, a fragmentary enlarged vertical section of a portion of the hole of FIG. 4.

DETAILED DESCRIPTION OF THE ILLUSTRATED EMBODIMENT

The invention provides an effective way of explosively breaking rock along desired break lines and substantially reducing or eliminating the formation of unwanted cracks extending into the rock. It does this by controlling the transmission to the rock to be broken of the explosive shock upon detonation of the explosive. By so controlling the transmission of the explosive shock to the rock, the shock transmitted can be adjusted and moderated as desired to provide the desired breaking force while eliminating the excessive shock that causes unwanted destructive cracking.

Figure 1:
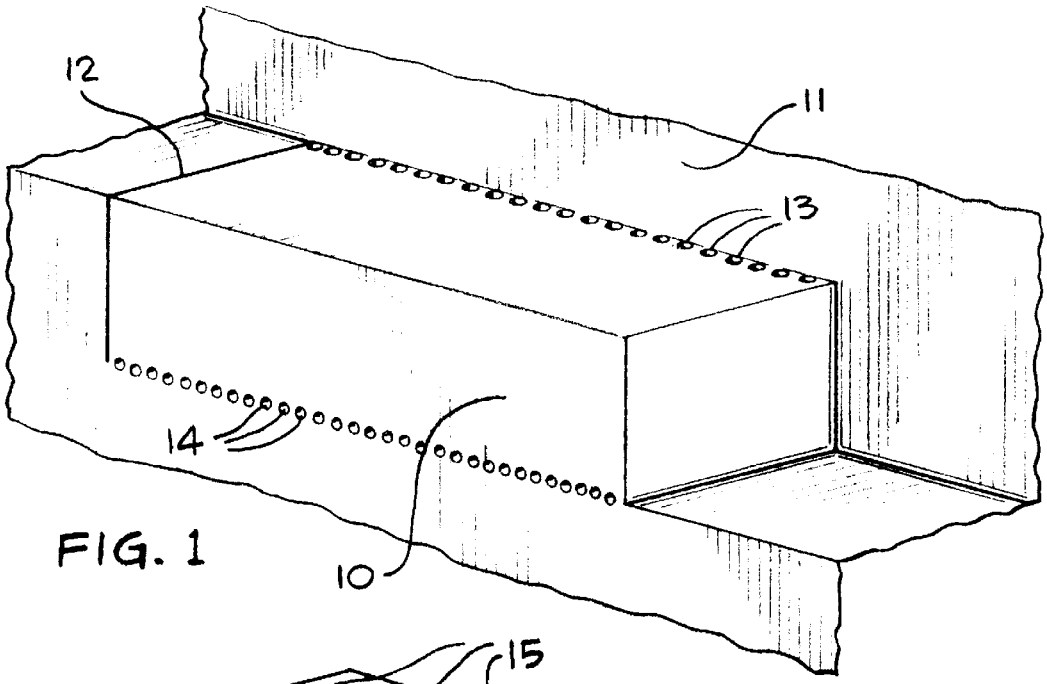
Figure 2:
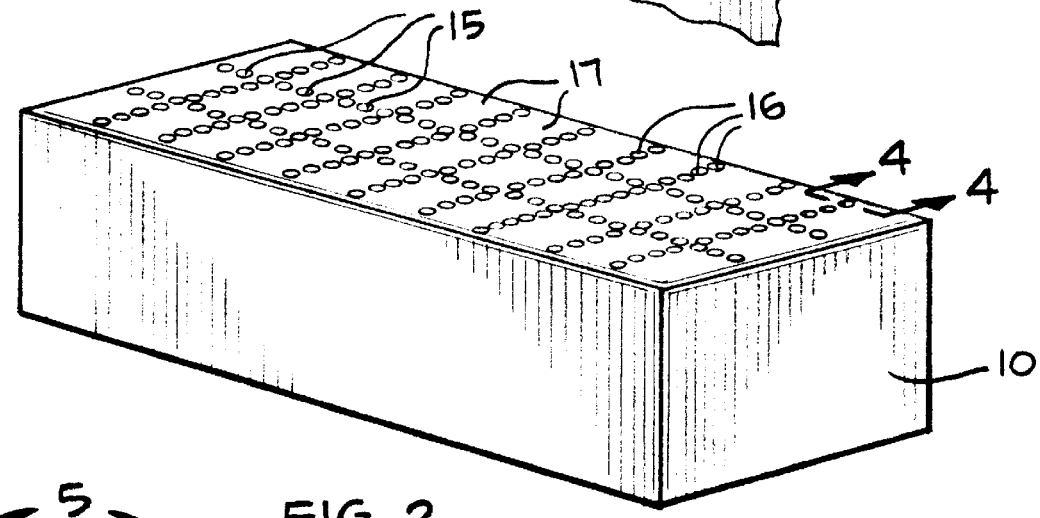
Figure 3:
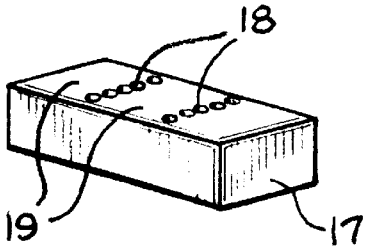

Rock loaves 10 or other rock pieces are generally broken from a rock formation 11, which may merely be a larger rock, by drilling a series of substantially evenly spaced bore holes into the rock along the desired break lines of the rock. When breaking a large rock loaf from a rock formation, the end of the loaf will usually be defined first by water jet cutting or by burning or spalling an end cut 12, FIG. 1. Bore holes 13 and 14 are drilled along the back and bottom, respectively, of the loaf to be removed. The spacing of the bore holes may vary depending upon the rock to be broken. In most granite quarries, for breaking large loaves and for breaking smaller blocks of granite from large loaves of granite, the holes are spaced about every five-and-one-half inches along the desired break lines. The bore holes are generally between one and one-and-one-quarter inches in diameter. The horizontal holes 14 at the bottom of the loaf are sloped at a small angle so that they may be filled with a liquid. In the prior art, the bore holes may be completely filled with explosives or may have a detonating cord placed therein and then filled with water. Detonation of the explosives or of the detonating cord separates the loaf 10 from the rock formation 11. When breaking a large loaf 10 into smaller loaves, see FIG. 2, vertical holes 15 and 16 are drilled into the loaf. The holes are drilled almost through the loaf to be broken but not all the way so that the holes may be filled with liquid. The loaf will typically be up to about fifty feet long, twenty feet wide, and fifteen feet high. It is desired to break this into smaller blocks, typically about six to eight feet long, six feet wide, and five feet high. To do this, vertical holes 15 are drilled along the longitudinal desired break lines and vertical holes 16 are drilled along the desired transverse break lines. The drilling of these bore holes is current practice for breaking loaves 10 into smaller blocks. In the prior art, detonating cord may be placed in the holes and the holes filled with water. Detonation of the detonating cord causes loaf 11 to be broken into a plurality of smaller blocks 17. These smaller blocks 17 are then placed on their side, FIG. 3, and vertical bore holes 18 are drilled along further desired break lines. In the prior art, detonating cord may be placed in these holes and the holes filled with water. Detonation of the detonating cord breaks block 17 into smaller blocks 19. These smaller blocks 19 are of generally desired size to be further finished by cutting and polishing. The prior art explosive methods of breaking the loaves into smaller blocks results in cracks, generally referred to as spider cracks, in the rock which requires the trimming of the sides of the rock to remove such cracks.

Figure 4:
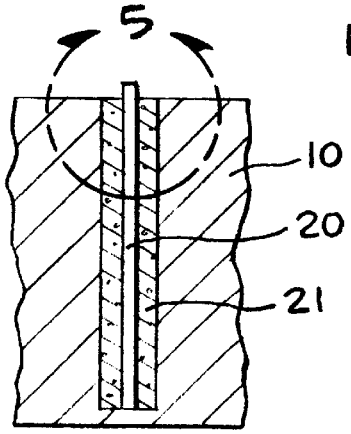
Figure 5:
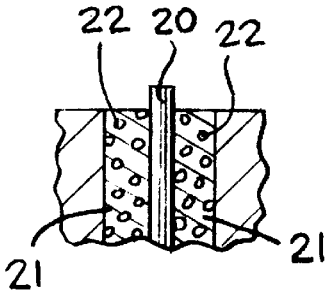

The invention involves the use of a shock transmitting and moderating composition filling the hole around the detonating cord in place of the water used in the prior art. Thus, for example, a length of detonating cord 20, FIG. 4, is placed in each hole, for example hole 15 in loaf 11, generally extending substantially the entire length of the hole. The hole is then filled with a gel 21. Gel 21 has shock absorbing material 22, FIG. 5, suspended in the gel to alter its force and shock transmitting properties. Gel 21 with shock absorbing material 22 is the shock transmitting and moderating composition. With water, the shock of the explosion is transmitted in such a way that in addition to breaking the rock along the desired break lines, spider cracks are formed extending into the blocks. Filling the hole with a straight gel has also been found to create the unwanted spider cracks. However, it has been found that if a shock absorbing material is suspended in the gel, the shock transmitting properties of the gel can be modified so that the rock breaks along the desired break lines, but formation of unwanted spider cracks is virtually eliminated.

The presently preferred shock absorbing material is microspheres, preferably glass microspheres. K1 glass bubbles as made by 3M Specialty Additives of St. Paul, Minn., have been found satisfactory and are currently preferred because they are relatively inexpensive (3M's most economical glass bubble), and appear to work as well as more expensive glass, ceramic, or plastic bubbles or microspheres.

A presently preferred gel is an aqueous guar gum gel with from about 0.6% to about 2% guar gum in water. A 2610 guar gum as made by Rhone-Poulenc has been found satisfactory, although various guar and other types of gum may be used. The 2610 has no preservative and blends well with water. Acid, such as acetic acid, is added as needed to adjust the pH of the gum solution to between about 3.5 to about 6. A pH in this range is generally necessary to allow the gum to thicken and to remain in its thickened condition. If the gel is to be kept for an extended period of time before use, usually more than several days, a preservative, such as Tektamer 38 made by Calgon Corp., should be added or a gum which includes a preservative, such as 8050 made by Rhone-Poulenc can be used. However, the 8050 guar gum does not mix as well with water and may require the addition of a carrier such as ethylene glycol. The preservative prevents the gum from breaking down.

For satisfactory shock absorption, it has been found that the glass bubbles should be suspended in the gel in the range of about 0.6 percent to about 2 percent.

In making the gel, the gum is mixed with water and any necessary acid, preservatives, and other desired ingredients, and the microspheres are mixed into the gel as it is gelling so as to be suspended substantially homogeneously in the gel. When gelled, the gel keeps the microspheres in suspension. The percentage of microspheres used will vary with the properties of the rock to be broken, the strength of the detonating cord to be used, and the microspheres and gel properties. The properties of the rock to be broken are important to consider as rocks from different areas, even the same type of rock, will vary substantially in properties such as compressive strength and bulk density. Fineness of grain of the rock is also important as finer grain rock is generally harder to break.

In mixing the gel, the various ingredients can be mixed in a mixer at the site of the bore holes and, when gelled sufficiently to keep the microspheres in suspension, poured into the bore holes around the detonating cord, or the gel can be mixed at a remote site and transported to the holes. For convenience, a dry mix of the gum, microspheres, dry acid, and other desired ingredients can be prepared and packaged, such as in bags, and transported to the mixing site where it is mixed with water to prepare the gel. Various mixers may be used, including an open container where the contents of the dry premix is added to water and the ingredients mixed manually, mechanically, or with a shovel. The mix is allowed to set to gel sufficiently to maintain the microspheres in suspension, and is then poured, pumped, or otherwise placed in the bore hole around the detonating cord. This mixture will usually gel about 80% in three to five minutes which is usually sufficient to hold the miscrosphere in suspension during pouring and further setting. Thus, the composition can usually be poured into the bore holes around the detonating cord within about three to five minutes after mixing. Further setting time may be allowed, if desired. The mixture generally will gel about 95% within thirty minutes. If it is desired to further harden or set the gel, crosslinking agents can be added to the gel mix. Where the gel is used in freezing conditions as in the winter in many quarries, material such as sodium chloride, magnesium chloride, or calcium chloride may be added to the water or the composition to depress the freezing point of the water and gel to provide time for the gel to form and be poured into a hole before it freezes. Once in the hole, it does not matter if the gel freezes.

EXAMPLE 1

The invention was used in breaking smaller blocks from a loaf of granite having compression strength of 22,650 PSI and bulk density of 168.4 lbs/ft$^3$. The gel used had the following composition:

| | |
|---|---|
| Water | 97.8% |
| Gum 2610 | 1.0% |
| Acid | 0.2% |
| Glass Bubbles K1 | 1.0% |

The detonating cord used was 7.5 grains per foot. The gel worked well to break blocks and the blocks were free of spider cracks.

EXAMPLE 2

The invention was used in breaking smaller blocks from a loaf of granite having compression strength of 17,550 PSI and bulk density of 167.3 lbs/ft$^3$. The gel used had the following composition:

| | |
|---|---|
| Water | 98.4% |
| Gum | 0.9% |
| Acid | 0.1% |
| Glass Bubbles K1 | 0.6% |

The detonating cord used was 10 grains per foot. The gel worked well to break blocks and the blocks were free of spider cracks.

EXAMPLE 3

The invention was used in breaking smaller blocks from a loaf of granite having compression strength of 22,650 PSI and bulk density of 168.4 lb/ft$^3$. The gel used had the following composition:

| | |
|---|---|
| Water | 98.2% |
| Gum | 0.85% |
| Acid | 0.1% |
| Glass Bubbles K1 | 0.85% |

The detonating cord used was 7.5 grains per foot. The gel worked well to break blocks and the blocks were free of spider cracks.

EXAMPLE 4

The invention was used in breaking smaller blocks from a loaf of granite having compression strength of 22,650 PSI and bulk density of 168.4 lbs/ft$^3$. The gel used had the following composition:

| | |
|---|---|
| Water | 96.7% |
| Gum 2610 | 1.1% |
| Acid | 0.2% |
| Glass Bubbles K1 | 2.0% |

The detonating cord used was 7.5 grains per foot. The gel density was about 0.8 and the gel did not work well in breaking the rock into blocks. Not enough of the explosive shock was transferred to the rock. Such composition may have worked if a detonating cord of greater explosive strength was used (a detonating cord of 10 grains per foot did not work satisfactorily, but detonating cord up to 40 grains per foot is available) or if the rock had lower compressive strength and/or bulk density.

It is currently contemplated that the glass bubbles may make up from about 0.6% to about 2% of the composition and that the gum may similarly make up from about 0.6% to about 2% of the composition. Below about 0.6% glass bubbles, the composition transmits too much shock to the rock (the shock is not moderated sufficiently) and spider cracks remain a problem. Above about 2% glass bubbles, too much shock is lost and breakage of the rock does not occur or occurs only with high explosive value detonating cord which currently adds unreasonably to the expense. With gum below about 0.6%, the composition generally does not gel sufficiently to keep the glass bubbles in suspension and above about 2%, the composition gels to an extent that makes it difficult to pump or pour and flow into the bore holes. However, with variations in the gel used and the shock absorbing material used, the proportions may change.

It has been found that rather than using microspheres in the gel, satisfactory results can be obtained by mixing very small gas bubbles, micro gas bubbles, into the gel. This can be done by mixing a gas bubble generating material (gassing agent) into the gel as the gel is being prepared. Satisfactory gas generating material includes sodium bicarbonate, $NaHCO_3$, and sodium nitrite $NaNO_2$.

EXAMPLE 5

A composition of the invention was prepared with a gel having the following composition by weight:

| | |
|---|---|
| Water | 98.0% |
| Sodium bicarbonate | 0.65% |
| Gum 2610 | 1.1% |
| Acetic Acid | 0.35% |

The final composition had a density of 0.70%/cc.

The composition was used similarly as the compositions of the prior examples and found to work well With the composition of Example 5, the gum forms the gel. The acid neutralizes the normal alkalinity of the sodium bicarbonate and forms minuscule gas bubbles that reduce the density of the final product to a quite low density depending on the amount of acid and sodium bicarbonate, in a similar manner as the beads in prior examples. The gel is thixotropic with a profusion of $CO_2$ bubbles of micron size. The bubbles provide the shock absorption.

The composition made in this way works satisfactorily for use soon after mixing, but the gas bubbles tend to migrate in the composition and do not remain distributed throughout the gel as required for effective use for periods beyond a day or two. The temperature of the gel appears to affect the shelf life with cooler temperatures providing longer shelf life.

With the composition of Example 5, it has been found that the amount of sodium bicarbonate can vary between about 0.2% and 0.75%, preferably between about 0.4% and 0.65%, the acetic acid between about 0.1% and about 0.5% and the the gum between about 0.8% and about 1.3%. Of course, these ranges will vary depending upon the type of acid used and type of gum used.

A second presently preferred embodiment of gel is a mixture of a high molecular weight acrylic thickener and water. A preferred thickener is Colloid 1560 made by Rhone Poulenc. The thickener is an emulsion which forms a liquid when mixed with water and which swells and thickens in solution when its normal pH range of about 2.4 is increased to a range of between about 8 and 9. The increase in pH can be obtained by adding an alkali such as aqua ammonia, sodium hydroxide, or other type of neutralizer to the aqueous thickener solution.

EXAMPLE 6

A composition of the invention was prepared with a gel having the following composition by weight:

| | |
|---|---|
| Water | 91.0% |
| Beads | 1.0% |
| Colloid 1560 | 4.0% |
| $NH_4OH$ | 4.0% |

The pH of the composition was about 9. The ammonia ($NH_4OH$) used can be a common household ammonia such as Parsons brand Household Ammonia with a density of about 0.983 gm/cc with a concentration of about 4%. The composition was used similarly as the composition of Examples 1–4 and found to work well.

EXAMPLE 7

A concentrated composition of the invention was prepared with the following composition:

| | |
|---|---|
| Water | 71.7% |
| Beads | 3.1% |
| Colloid 1560 | 12.6% |
| $NH_4OH$ | 12.6% |

Mixed in these proportions and in this order, a thick gel is formed. It is thixotropic in nature and may be shipped to the site of use. Prior to use, it is diluted one part concentrate to one part water. This forms a composition of pourable consistency with water content of 91.0%. This gives a final diluted composition with 1.0% beads, 4.0% Colloid 1560, and 4.0% aqua ammonia, i.e., a composition the same as that of Example 6. Addition of the water to make the final product constituency noted must be accompanied by adequate mixing to make a uniform pourable gel.

EXAMPLE 8

A more concentrated composition of the invention was prepared with the following composition:

| | |
|---|---|
| Water | 45% |
| Beads | 10% |
| Colloid 1560 | 40% |
| $NH_4OH$ | 5% |

Again, with this composition a thick thixotropic gel is formed. It may be prepared at a central location and shipped to the site of use where it is then mixed one part to nine parts of water plus about 3% additional ammonia to provide a final formulation as shown in Example 6. The additional ammonia is needed to give a final pH over 8 (any value over 8 will work) so the product remains thickened.

With the Colloid 1560, satisfactory compositions can be obtained with from about 2% to about 12% Colloid 1560 and, as explained for the gum compositions, from about 0.6% to about 3% beads. The ammonia or other alkali is used as needed to adjust the pH to greater than 8.

When using an acrylic thickener, the final product and any concentrate for the product should be kept covered to avoid exposure to air and resultant possible change and possible crusting due to prolonged, contact and oxidation with air.

Other swellable acrylic polymer emulsions are available from different sources, such as Acrysol TT 615 from Rohm & Haas, and Carbopol EZ-2 and Carbopol 676 both from B. F. Goodrich. The B. F. Goodrich and Rohm & Haas products that exhibit similar swelling characteristics when put in solution register a low pH around 2.4 to 3.0, and when dispersed in the water carrier, with some difficulty compared with the Colloid 1560, show little or no viscosity change. When partially neutralized to about pH 7.0, as with the Colloid 1560, they yield a significantly higher viscosity and produce a pourable gel similar to that produced with the Colloid 1560. The B. F. Goodrich and Rohm & Haas products are supplied as a powder rather than an emulsion as in the Colloid 1560. Referring to the powder, concentration of about 0.5% give comparable compositions to the indicated 4% of Colloid 1560. The proportion used can vary as with the Colloid 1560. The Colloid 1560 is presently preferred because of ease of use—it is easier to mix the emulsion with water than the powder—and because it is more economical.

While the Examples all deal with breaking of loaves into smaller blocks, the same method and gel composition may be used in separating the loaves from rock formations. In such cases the detonating cord used will usually be up to about a fifty grain cord to provide more explosive power for breaking the larger loaves from the rock formation. However, use of the gel is the same. Further, it has been found that by using the method and composition of the invention, in many cases the end of the loaf can be formed by bore holes and explosives along with the rear and bottom of the loaf, eliminating the need for water jet cutting or burning or spalling.

In addition, while it has been indicated the bore holes are generally spaced about five and one half inches apart along the desired line of breakage of the rock, the spacing of such bore holes may vary with spacing up to about one foot between holes being used. The specific detonating cord used may vary with the spacing of the bore holes, greater power detonating cord generally being used with greater spacing of the holes. Also, while the bore holes have been indicated as generally being between about one and one and one-quarter inches in diameter, the bore holes may be larger, with holes up to about three inches used in some instances. Smaller holes may also be used.

While microspheres, specifically glass bubbles, have been set forth as the shock absorbing means or material, other material such as sawdust, nut shell grounds, pearlite, various plastic beads such as styrene, divinylbenzene, urea, and phenol formaldehyde, and foamed plastic beads such as polystyrene and similar foamed beads, may be used as the shock absorbing means in the gel. Of course, with other shock absorbing materials, the percentage of the materials in the gel must be adjusted to provide the desired results.

Various acids in addition to the liquid acetic acid mentioned may be used for pH control. For example, dry acids such as fumaric acid, tartaric acid, maleic acid, citric acid, or quinic acid may be used.

While the invention so far has been described in connection with splitting of rock in stone quarries where the rock is the desired end product and cracks reduce the value of the rock, it can be used in other instances where excessive cracking of rock is undesirable. One of the other areas is in underground mining where cracking of a mine shaft, tunnel, or drift walls and roof can result in unstable walls and roof and in pieces of rock breaking off of the walls, and particularly the roof, and injuring a miner. In such case, the invention can be used to reduce cracking of the walls and roof of a mine shaft, tunnel, drift, or other opening to be made in the rock. The reduced cracking provides more stable walls and roof.

When blasting mine shafts, tunnels, drifts, or other openings, it is common to produce a series of bore or blast hole groups from the center of the desired opening to the desired walls, roof, and floor. Thus, a blast hole would be drilled approximately in what will become the center of the shaft, tunnel, or drift, a series of holes will be drilled along the line that will become the walls, roof, and floor of the shaft, tunnel, or drift, and usually two or more additional sets of blast holes will be drilled in between. Blasting then usually is done in staggered fashion, such as detonating the center blast hole first to break rock in the center of the area to become the opening and then detonating the outside holes to create the walls and roof, with other sets of holes being detonated to then break up the larger blocks so they can be removed to open up the shaft, tunnel, or drift. In some instances other orders of detonation will be used.

When using the composition of the invention, it will be used at least in the outer set of holes, i.e., the ones defining the periphery of the opening to be made, to reduce cracking that would otherwise extend into the walls, roof, and floor. Also, it has been found that satisfactory results can be obtained in such blasting with bead or bubble concentration in the gel as low as about 0.1%.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. An nonexplosive shock transmitting and moderating composition for transmitting the force of an explosive blast to material to be acted on by the explosive force, but at a reduced force, consisting essentially of:

a nonexplosive gel; and shock absorbing means suspended in the gel, said gel and absorbing means being interposed between the explosive and the material to be acted on for transmission of blast force thereto.

2. An nonexplosive shock transmitting and moderating composition according to claim 1, wherein the shock absorbing means are gas bubbles.

3. An nonexplosive shock transmitting and moderating composition according to claim 2, wherein the gas bubbles are generated upon mixing of the composition by a gassing agent which reacts with other ingredients of the composition to generate the gas bubbles.

4. An nonexplosive shock transmitting and moderating composition according to claim 3, wherein the gassing agent is sodium bicarbonate which reacts with acid to form gas bubbles.

5. An nonexplosive shock transmitting and moderating composition according to claim 4, wherein the sodium bicarbonate makes up between about 0.4% and about 0.65% by weight of the composition at the time of mixing and acid makes up between about 0.1% and about 0.5%.

6. An nonexplosive shock transmitting and moderating composition according to claim 3, wherein the gassing agent is sodium nitrite.

7. An nonexplosive shock transmitting and moderating composition according to claim 1, wherein the gel is a mixture of water and an acrylic thickener.

8. An nonexplosive shock transmitting and moderating composition according to claim 7, wherein the acrylic thickener makes up between about 2% to about 12% by weight of the composition.

9. An nonexplosive shock transmitting and moderating composition according to claim 7, wherein the composition is made from a gel concentrate which is diluted and mixed with water.

10. An nonexplosive shock transmitting and moderating composition according to claim 9, wherein the concentrate is formulated to be mixed one part concentrate to up to nine parts water.

11. An nonexplosive shock transmitting and moderating composition according to claim 10, wherein an alkali is added to the water and concentrate mixture to adjust the pH of the mixture to a value to cause the mixture to form a gel.

12. An nonexplosive shock transmitting and moderating composition according to claim 1, wherein the gel includes a gum.

13. An nonexplosive shock transmitting and moderating composition according to claim 1, wherein the shock-absorbing means are hollow microspheres.

14. An nonexplosive shock transmitting and moderating composition according to claim 13, wherein the hollow microspheres are glass bubbles.

15. An nonexplosive shock transmitting and moderating composition according to claim 13, wherein the microspheres make up to about 2% by weight of the composition.

16. An nonexplosive shock transmitting and moderating composition according to claim 14, wherein the microspheres make up between about 0.6% and 2% by weight of the composition.

17. An nonexplosive shock transmitting and moderating composition according to claim 13, wherein the microspheres make up at least about 0.1% by weight of the composition.

18. An nonexplosive shock transmitting and moderating composition according to claim 12, wherein the gum is a guar gum.

19. An nonexplosive shock transmitting and moderating composition according to claim 18, wherein the gum makes up to about 2% by weight of the composition.

20. An nonexplosive shock transmitting and moderating composition according to claim 18, wherein the composition comprises about 0.6% to about 2% microspheres, about 0.6% to about 2% guar gum, about 0.1% to about 0.2% acid, with the remainder of the composition being water.

* * * * *